United States Patent [19]

Gemperle

[11] Patent Number: 4,767,033

[45] Date of Patent: Aug. 30, 1988

[54] MANUALLY OPERATED GEAR PUMP SPRAY HEAD

[75] Inventor: Edward C. Gemperle, Cincinnati, Ohio

[73] Assignee: The Drackett Company, Cincinnati, Ohio

[21] Appl. No.: 144,586

[22] Filed: Jan. 6, 1988

Related U.S. Application Data

[63] Continuation of Ser. No. 891,080, Jul. 31, 1986, abandoned.

[51] Int. Cl.[4] ..... B05B 11/00; B67D 5/42

[52] U.S. Cl. ..... 222/383; 222/482; 239/333; 418/198

[58] Field of Search ..... 222/251, 255, 321, 372, 222/382, 383, 385, 391, 464, 481, 482, 484; 239/329, 331–333; 418/198

[56] References Cited

U.S. PATENT DOCUMENTS

| | | | |
|---|---|---|---|
| 1,061,062 | 5/1913 | Freeland | 222/372 X |
| 2,651,545 | 9/1953 | Shotton | 239/333 |
| 3,993,250 | 11/1976 | Shure | 239/332 |
| 4,013,074 | 3/1977 | Siposs | 222/386.5 X |
| 4,153,203 | 5/1979 | Tada | 222/383 X |
| 4,187,959 | 2/1980 | Pelton | 222/383 X |
| 4,232,828 | 11/1980 | Shelly, Jr. | 239/329 |

FOREIGN PATENT DOCUMENTS

| | | | |
|---|---|---|---|
| 548655 | 1/1923 | France | 222/383 |

*Primary Examiner*—Kevin P. Shaver
*Attorney, Agent, or Firm*—Gene Warzecha

[57] ABSTRACT

A spray head containing a gear pump for drawing liquid from a container and forcing same out of a nozzle. The gear pump comprises a pair of operatively engaged gears each rotatable about horizontal axes transverse to the axis of the nozzle. A ratchet wheel is axially secured to one of the gears and the ratchet and its gear are intermittently rotated about their common axis by a pawl member which is attached to a manually operable trigger which moves in a plane within the plane of the gears.

1 Claim, 1 Drawing Sheet

MANUALLY OPERATED GEAR PUMP SPRAY HEAD

This is a continuing application of application Ser. No. 891,080 filed July 31, 1986, now abandoned.

BACKGROUND OF THE INVENTION

1. Field of the Invention

The invention relates generally to spraying mechanisms which may be detachably connected to a container for spraying the contents thereof. More particularly, the invention relates to manually activated spray heads.

2. Description of the Prior Art

Manually activated spray heads are well known for spraying products such as window cleaners, all-purpose cleaners, hair sprays, etc. Most of such prior art spray heads are either of the piston or the bulb type.

In the piston type spray head, a manual trigger mechanism forces a piston to expel a predetermined volume of fluid from the nozzle. An arrangement of tubes and check valves enables the spray head to move fluid in a predetermined direction during operation of the trigger mechanism (i.e. only from container to nozzle and not back). In a bulb-type spray head, a manual trigger mechanism is used to squeeze a predetermined amount of fluid from a bulb. An arrangement of tubes and valves is also utilized to enable fluid flow only in a predetermined direction.

One other type of liquid spray head (disclosed in U.S. Pat. No. 4,232,828) utilizes a removable liquid conduit in combination with a star-shaped rotor rotatably driven by a manual trigger mechanism. Activation of the trigger causes the star-shaped rotor to compress the liquid conduit in an undulating manner and force liquid therefrom to the spray head nozzle.

All of the foregoing prior art spray head mechanisms suffer from various disadvantages. They are all generally complex and require the assembly of many different parts. Those spray heads utilizing flexible components (bulbs, conduits, etc.) have a tendency to deteriorate over time. The check-valves incorporated in these various mechanisms either lose resiliency or get clogged with the product being sprayed. Furthermore, none of the prior art spray heads may be easily adjusted to deliver product at a variable rate. That is, once a predetermined spray head is designed with certain dimensions, it will deliver a predetermined quantity of product at a predetermined rate. Changing either the desired volume or rate requires redesign of substantially the entire unit.

Gear pump spray heads are known in the prior art for spraying container contents such as paint, etc. Gear pumps may generally avoid check-valves and other disadvantages of prior art spray heads and are shown in U.S. Pat. Nos. 2,651,545 and 3,993,250. However, both of these devices require continuously rotating electrically or battery operated drive motors. Consequently, these devices are too complex and costly for many applications. The continuous drive feature also makes such spray heads unsuitable for many applications where an intermittent spray operation is acceptable or desirable from either a cost or efficiency point of view.

To overcome the disadvantages of the prior art, it is an object of this invention to produce a manually operated spray head requiring fewer parts than prior art piston or bulb-type spray heads. It is a further object of this invention to provide a manually operated spray head which is operable without the need for check valves. It is yet another object of this invention to provide a manually operated spray head which may be easily and inexpensively assembled. It is still a further object of this invention to provide a manually operated spray head design which may be relatively easily adjusted to vary the delivery rate of the spray head.

SUMMARY OF THE INVENTION

These and other objects of the invention are achieved by the preferred embodiment thereof which is, in a gear pump spray head having a manually activated trigger and spring means for returning the trigger to its neutral position, the improvement comprising: a ratchet wheel axially secured to one of the gears of said gear pump; and pawl means interposed between said trigger and said ratchet wheel for rotating the latter upon activation of said trigger.

DESCRIPTION OF THE PREFERRED EMBODIMENT

Figure 1:
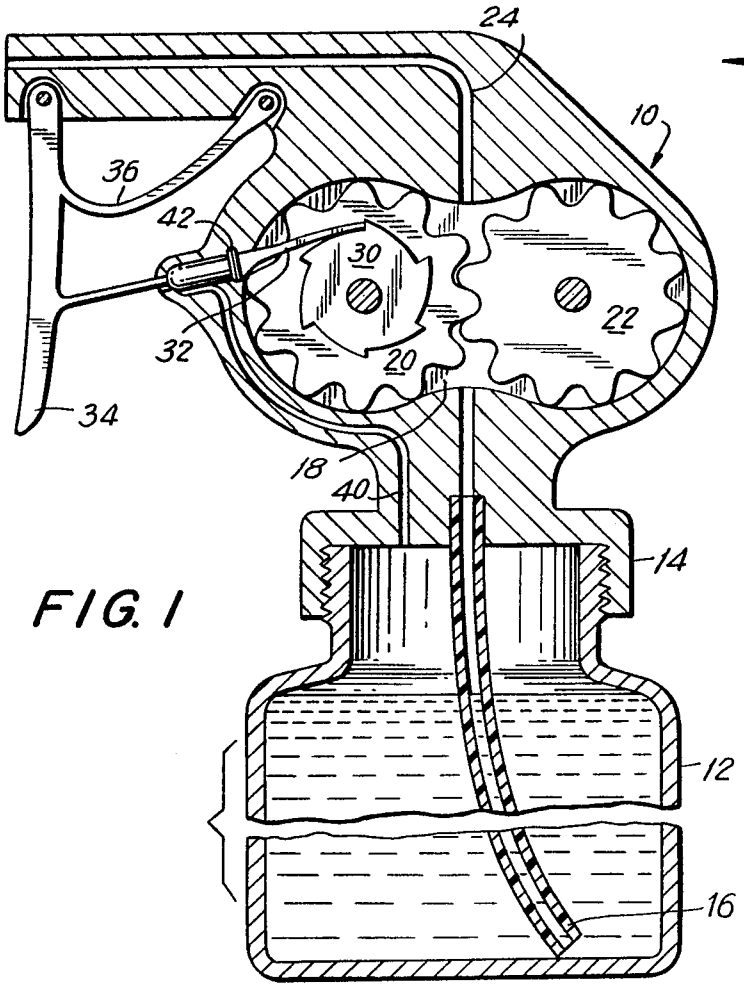
FIG. 1 shows a diagrammatic cross-sectional elevational view of a spray head constructed in accordance with the principles of this invention.

Referring now to FIG. 1, there is shown a spray head 10 constructed in accordance with the principles of this invention. Spray head 10 is intended for use with a container 12 (filled with liquid to be sprayed) and is provided with an integrally molded threaded cap 14 for threadable engagement with container 12. Spray head 10 further comprises an inlet tube 16, the lower end of which extends into the bottom of container 12 and the upper end of which opens into gear housing chamber 18.

Chamber 18 contains two counter-rotating gears 20 and 22 each rotatably mounted about parallel spaced axes. Those skilled in the art will understand that the construction and assembly of housing chamber 18 and gears 20 and 22 must be of sufficiently close tolerance to enable the operation of the gears in a conventional manner associated with gear pumps. In such operation, gears 20 and 22 will, upon rotation in the indicated directions, cause a reduction in pressure on the intake side of the gears and will cause fluid to be drawn from tube 16 into the lower portion of the housing chamber 18. The fluid is then forced around the periphery of gears 20 and 22 and into outlet tube 24. Outlet tube 24 may terminate in a conventional nozzle assembly (not shown) to provide the desired spray pattern emanating from the spray head in a conventional manner.

Figure 2:
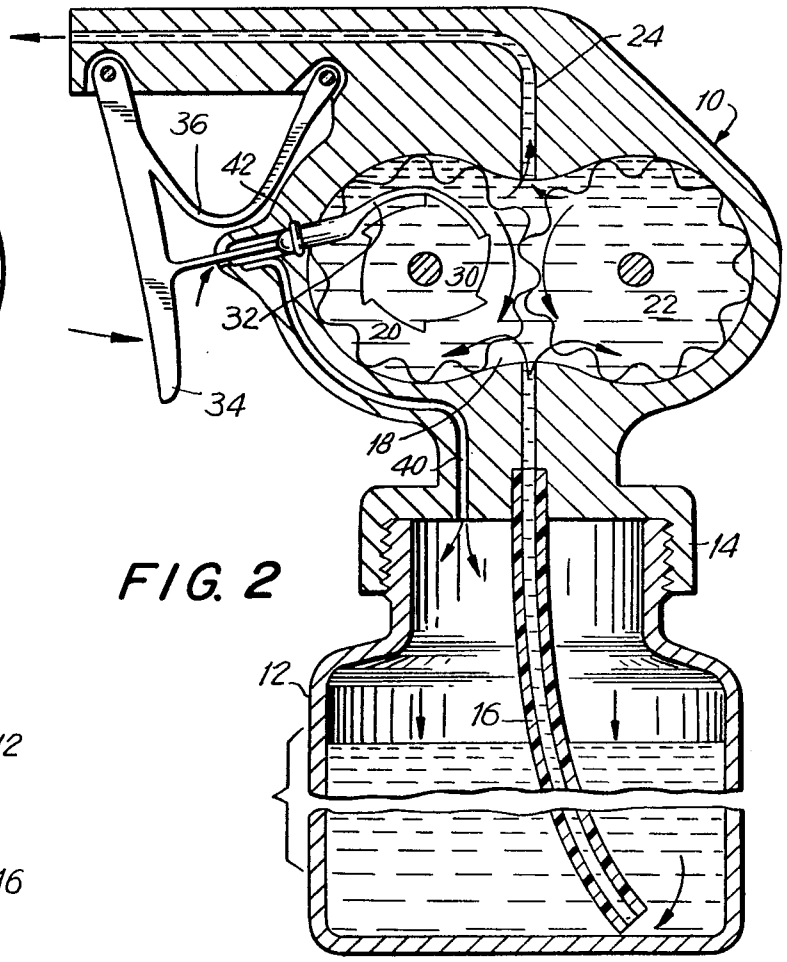
FIG. 2 is a view of FIG. 1 with the trigger depressed.

Gear 20 is provided with a ratchet wheel 30 secured to the axle thereof for rotating therewith. Ratchet wheel 30 is driven by pawl member 32 which is connected to trigger 34. It will be noted that trigger 34 is biased in a neutral position by spring member 36. Activating trigger 34 by manually depressing it as shown in FIG. 2 causes pawl member 32 to rotate ratchet wheel 30 clockwise. This necessarily causes rotation of gears 20 and 22 and operation of the gear pump in an intermittent fashion. The inherent friction associated with the assembled components causes gears 20 and 22 to remain stationary in the absence of any driving force. It will be understood that pawl member 32 may be rigid or flexible. If rigid, pawl member 32 will rotate ratchet wheel 30 until the pawl eventually disengages from a particular tooth or the ratchet wheel, at which time trigger 34 may be released to return the pawl to engage another ratchet tooth. Pawl member 32 may be flexible to wrap around ratchet wheel 30 as shown, for example, in FIG. 2. This enables a longer stroke although such a structure requires additional means (not shown) to retain pawl member 32 in engagement with the ratchet tooth beyond the point at which the pawl is tangent to the wheel.

Spray head 10 further includes a vent tube 40 providing an air path between the interior of container 12 and the atmosphere. Depression of trigger 34 will, because of exposure of the top end of tube 40 in the passage through which pawl member 32 passes enables pressure equalization. A suitable O-ring 42 or other means may be utilized to prevent fluid from leaking out of chamber 18 during operation of the spray head.

It will be understood that the rate at which liquid is dispensed from spray head 10 may be adjusted by changing either the size or number of teeth on either or both ratchet wheel or the gears without the necessity of changing any other components within spray head 10. Thus, a manufacturer may easily produce spray heads for various uses at minimal expense.

It will be understood by those skilled in the art that numerous improvements and modifications may be made to the preferred embodiment of the invention disclosed herein without departing from the spirit and scope thereof.

What is claimed is:

1. A manually operated gear pump spray head for spraying the contents of a container to which said spray head is attachable, said container capable of being held in one hand, said spray head comprising:

a housing provided with a nozzle;

a pair of operatively engaged gears, each rotatable about a respective one of a pair of spaced axes transverse to the axis of said nozzle;

a manually activated trigger operable, with the same hand holding said container, between a neutral position and a depressed position for activating said spray head;

a ratchet wheel axially secured to one of said gears;

pawl means interposed between said trigger and said ratchet wheel for rotating the latter upon movement of said trigger toward its depressed position;

a spring means for returning said trigger to its neutral position;

vent tube means for providing a passage between the interior of said container and the ambient environment; and a seal between said trigger and said pawl for closing said passage when said trigger is in its neutral position and for opening said passage when said trigger is in its depressed position.

* * * * *